US006619808B1

(12) United States Patent
Pelto

(10) Patent No.: US 6,619,808 B1
(45) Date of Patent: Sep. 16, 2003

(54) CHEMILUMINESCENT DEVICE HAVING A MULTI-COLORED CASING AND METHOD THEREFOR

(76) Inventor: Aaron Pelto, 1739 E. Broadway Suite 1-123, Tempe, AZ (US) 85282

( * ) Notice: Subject to any disclaimer, the term of this patent is extended or adjusted under 35 U.S.C. 154(b) by 0 days.

(21) Appl. No.: 10/102,747

(22) Filed: Mar. 22, 2002

(51) Int. Cl.[7] ..... F21K 2/00

(52) U.S. Cl. ..... 362/34; 362/84; 362/101; 206/219

(58) Field of Search ..... 362/34, 84, 101, 362/159, 104, 154, 231, 238; 206/219

(56) References Cited

U.S. PATENT DOCUMENTS

RE30,103 E * 9/1979 Spector ..... 362/34
4,954,113 A 9/1990 Kim
5,043,851 A 8/1991 Kaplan
5,383,100 A 1/1995 Kikos
5,390,086 A 2/1995 Holland
5,557,869 A 9/1996 Doulgas
6,106,129 A 8/2000 Cranor
6,196,921 B1 3/2001 Larson
6,257,750 B1 7/2001 Strasser

* cited by examiner

*Primary Examiner*—Sandra O'Shea
*Assistant Examiner*—John Anthony Ward
(74) *Attorney, Agent, or Firm*—Jeffrey Weiss; Harry M. Weiss; Weiss, Moy & Harris, P.C.

(57) ABSTRACT

A chemiluminescent device having a casing with distinct regions having different colored appearances, so that a single color of light produced by the reaction of chemiluminescent reaction may produce a multicolored appearance. Preferably, the regions are formed into discrete designs as defined by the shapes of the regions.

5 Claims, 1 Drawing Sheet

CHEMILUMINESCENT DEVICE HAVING A MULTI-COLORED CASING AND METHOD THEREFOR

FIELD OF THE INVENTION

This invention relates generally to chemiluminescent devices and methods therefor and, more specifically, to a chemiluminescent device in which a single color of light produced by a chemiluminescent reaction is transmitted through a multi-colored casing to produce a multi-color effect.

BACKGROUND OF THE INVENTION

Chemiluminescent devices are well known. They generally comprise an outer casing, within which are positioned the reactants in a chemiluminescent reaction. These reactants are typically an activator, an oxalate, and a dye in solvent. So that the reaction will not take place before the device is ready to be used, it is necessary to place either the activator or oxalate in a breakable ampule, which when broken allows the reactants to mix, producing light.

Prior art chemiluminescent devices typically display only a single color. It is possible to vary a particular color produced by the reaction by changing the particular reactants used. The prior art includes reactants capable of producing blue, green, yellow, or red light.

U.S. Pat. No. 5,390,086, issued to Holland, however, discloses a device having at least two separate chambers, each containing its own set of chemiluminescent reactants—including different colored dyes. When each individual reaction is allowed to proceed, the devices is capable of producing more than one color of light. There are several drawbacks associated with the Holland device. It is relatively complicated and relatively expensive to manufacture, given the need to provide a structure having multiple chambers and the need to provide multiple dyes.

A need therefore existed for a chemiluminescent device and method capable of using a single dye and a single set of reactants to create a multi-color effect. A need still further existed for a chemiluminescent device and method capable of producing a multi-colored, illuminated design having discrete features. The present invention satisfies these needs and provides other, related, advantages.

SUMMARY OF THE INVENTION

An object of the present invention is to provide a chemiluminescent device and method capable of using a single dye and a single set of reactants to create a multi-color effect.

A further object of the present invention is to provide a chemiluminescent device and method capable of producing a multi-colored, illuminated design having discrete features.

BRIEF DESCRIPTION OF THE PREFERRED EMBODIMENTS

In accordance with one embodiment of the present invention, a chemiluminescent device is disclosed capable of producing a multi-colored effect is disclosed. The device comprises, in combination: chemiluminescent reactants capable of producing light having a first colored appearance; and a casing containing the chemiluminescent reactants and capable of permitting the light to pass through at least a portion thereof; wherein the casing comprises at least a first and a second region, wherein the first region and the second region exhibit distinct color characteristics from one another; wherein the light, upon passing through at least one of the first region and the second region, takes on a second colored appearance.

In accordance with another embodiment of the present invention, a method of producing a multi-colored effect in a chemiluminescent device is disclosed. The method comprises the steps of: providing chemiluminescent reactants capable of producing light having a first colored appearance; providing a casing containing the chemiluminescent reactants and capable of permitting the light to pass through at least a portion thereof; wherein the casing comprises at least a first and a second region, wherein the first region and the second region exhibit distinct color characteristics from one another; wherein the light, upon passing through at least one of the first region and the second region, takes on a second colored appearance; and allowing the chemiluminescent reactants to combine.

DETAILED DESCRIPTION OF THE PREFERRED EMBODIMENTS

Figure 1:
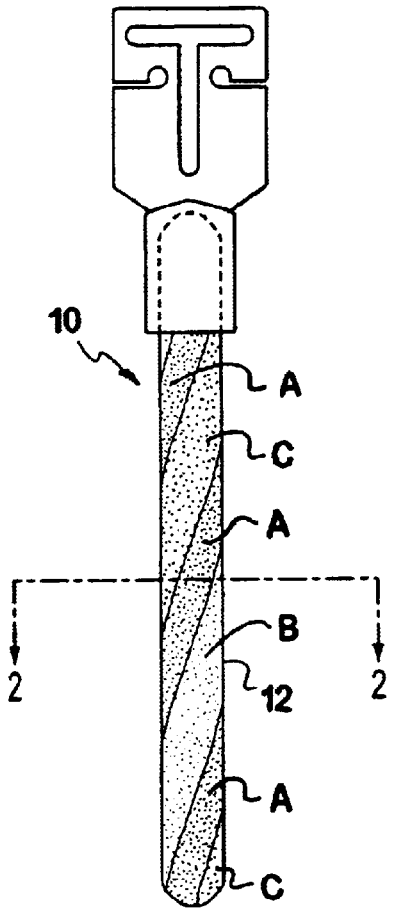
FIG. 1 is a front view of an embodiment of multi-colored chemiluminescent device of the present invention.
Figure 2:
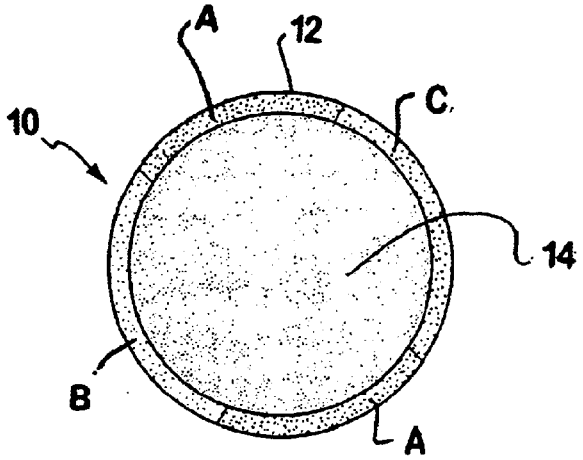
FIG. 2 is a cross-sectional view of the device of FIG. 1, taking along line 2—2.

Referring now to FIGS. 1–2, an embodiment of the device 10 of the present invention is shown. In this embodiment, the device 10 is what is commonly referred to as a light stick. Chemiluminescent devices having other configurations are also known, including for example necklaces, bracelets, and others. The term"device" as used herein is intended to refer to any type of chemiluminescent device.

The casing 12 surrounds the chemiluminescent reactants 14 located therein, and permits the transmission of light therethrough. The casing 12 may be comprised of materials known in the art for such use. The chemiluminescent reactants 14 are preferably reactants capable of producing light having a single colored appearance (including white), including any of the chemiluminescent reactants known in the art. For some embodiments, it may be desired to provide more than one set of chemiluminescent reactants 14, including in individual chambers, so that more than one color of light can be produced, which light will then be transmitted through a casing 12 as herein described.

The casing 12 comprises at least two regions A and B, wherein regions A and B are differently colored. In this regard, it would be possible to have a region A that is not colored and thus will not alter the colored appearance of the light produced by the chemiluminescent reaction, and a region B that is colored. It would also be possible to have a region A that is opaque, and that will not permit the passage of light therethrough, so as to contribute to the creation of a desired visual effect in combination with other regions that do permit passage. Generally, it will be preferred that region A and region B each be colored and that the two colors be distinct from one another.

As shown in FIG. 1, more than two regions A and B may be provided, and the device 10 illustrated therein has a third region C. Region C is preferably colored, and is preferably different from each of regions A and B. It should be noted that it would be possible to provide more than three regions A, B, and C. It should also be noted that, depending on the type of visual effect that is sought to be created, it may be desirable to have two or more regions having one color, which color would be distinct from that of one or more other regions. Within the limits of there being at least two, distinct, regions A and B, the appearance of the casing 12 may be varied in an essentially infinite number of ways.

Still referring to FIG. 1, it is preferred to organize the regions into a discrete design, defined by the shapes of the different regions. For example, the device 10 of FIG. 1 illustrates one embodiment of the present invention, having a candy-cane or barber-shop pole type of design, with regions A, B and C swirling along the length of the device 10—and with region A being repeated twice. Thus, the embodiment of FIG. 1 consists of two sections A having a first color, a section B having a second color, and a section C having a third color. In this manner, a single color of light emitted by the reactants 14 will be exhibited as colors A, B and C, depending on the portion of the casing 12 through which they are transmitted.

The variations on this design, and thus the different possible embodiments of the present invention, are essentially infinite. For example, the regions could be colored and organized to create a zebra design, a cheetah design, team colors, names, logos, animated characters, political messages, religious messages, safety messages, and so forth.

The casing 12 is preferably formed in a process by which the portions comprising each region to be used in the design are first created from suitable casing material, in the desired size and shape taking into account the type of chemiluminescent device that is to be created. The regions are then fused together in the shape of the casing, with the reactants being inserted therein before the casing is sealed. Other methods of manufacture, such as the dying of the casing 12 to create the different regions, may also be possible.

While the invention has been particularly shown and described with reference to preferred embodiments thereof, it will be understood by those skilled in the art that the foregoing and other changes in form and details may be made therein without departing from the spirit and scope of the invention.

I claim:

1. A chemiluminescent device capable of producing a multi-colored effect comprising, in combination:

chemiluminescent reactants capable of producing light having a first colored appearance; and a casing defining a sealed container adapted to hold said chemiluminescent reactants and capable of permitting said light to pass through at least a portion thereof;

wherein at least one of said chemiluminescent reactants contacts an interior surface of said casing;

wherein said casing comprises at least a first and a second region, wherein said first region and said second region exhibit distinct color characteristics from one another;

wherein said light, upon passing through at least one of said first region and said second region, takes on a second colored appearance.

2. The device of claim 1 wherein said light, upon passing through said first region takes on said second colored appearance and upon passing through said second region takes on a third colored appearance.

3. The device of claim 2 wherein said casing further comprises a third region, wherein said first region, said second region, and said third region exhibit distinct color characteristics from one another; and wherein said light, upon passing through said third region, takes on a fourth colored appearance.

4. The device of claim 1 wherein said first region and said second region form a discrete design defined at least by shapes of said first region and said second region.

5. The device of claim 3 wherein said first region, said second region, and said third region form a discrete design defined at least by shapes of said first region, said second region and said third region.

* * * * *